US010780953B2

(12) United States Patent
Choi

(10) Patent No.: US 10,780,953 B2
(45) Date of Patent: Sep. 22, 2020

(54) ANCHOR FOR A SHIP

(71) Applicant: PSKOREA CO., LTD, Daejeon (KR)

(72) Inventor: Pil Sun Choi, Daejeon (KR)

(73) Assignee: PSKOREA CO., LTD, Daejeon (KR)

( * ) Notice: Subject to any disclaimer, the term of this patent is extended or adjusted under 35 U.S.C. 154(b) by 0 days.

(21) Appl. No.: 16/279,736

(22) Filed: Feb. 19, 2019

(65) Prior Publication Data

US 2019/0256171 A1 Aug. 22, 2019

(30) Foreign Application Priority Data

Feb. 20, 2018 (KR) ..... 10-2018-0019878

(51) Int. Cl.
*B63B 21/24* (2006.01)

(52) U.S. Cl.
CPC ..... *B63B 21/243* (2013.01); *B63B 21/24* (2013.01)

(58) Field of Classification Search
CPC ..... B63B 21/00; B63B 21/24; B63B 21/243; B63B 21/44; B63B 21/46; B63B 2221/08; B63B 2221/22
USPC ..... 114/298, 303
See application file for complete search history.

(56) References Cited

U.S. PATENT DOCUMENTS 1,782,449 A * 11/1930 Siebert ..... B63B 21/243 114/298
2,985,132 A * 5/1961 Detrick ..... B63B 21/243 114/298
2,990,800 A * 7/1961 Chard ..... B63B 21/44 114/298
3,138,134 A * 6/1964 Botine ..... B63B 21/243 114/298
3,283,736 A * 11/1966 Williams ..... B63B 21/243 114/298
3,672,321 A * 6/1972 Tuel ..... B63B 21/243 114/297
3,747,553 A * 7/1973 Riddle, Sr. ..... B63B 21/243 114/298
4,005,671 A * 2/1977 Ogle ..... B63B 21/243 114/298
4,038,934 A * 8/1977 Thomson ..... B63B 21/243 114/298
4,057,024 A * 11/1977 Adams ..... B63B 21/243 114/298
4,111,147 A * 9/1978 Morissette ..... B63B 21/243 114/298

(Continued)

FOREIGN PATENT DOCUMENTS

KR 10-1185741 B1 9/2012
KR 10-1805001 B1 11/2017

*Primary Examiner* — Lars A Olson
(74) *Attorney, Agent, or Firm* — Novick, Kim & Lee, PLLC; Jae Youn Kim

(57) ABSTRACT

Provided is an anchor for a ship that may facilitate retrieval of the anchor as a folding operation of the anchor is smoothly performed by improving a design of a contact portion such that a mechanical contact resistance of components that perform a folding operation of the anchor is minimized. Consequently, the anchor may be easily retrieved without cutting the wire or the iron chain, that is, without loss of the anchor in a situation in which the anchor arm is caught by an underwater structure not to be pulled out when the ship leaves a harbor after the mooring.

7 Claims, 11 Drawing Sheets

(56) References Cited

U.S. PATENT DOCUMENTS 4,543,904 A * 10/1985 Puoti ..... B63B 21/243
114/298
4,577,582 A * 3/1986 Hedden ..... B63B 21/243
114/298
5,215,030 A * 6/1993 Conti ..... B63B 21/46
114/298

* cited by examiner

ANCHOR FOR A SHIP

CROSS-REFERENCE IN THE RELATED APPLICATIONS

This application claims priority to and benefit of KR10-2018-0019878, filed Feb. 20, 2018, of which disclosure is incorporated herein by reference in its entirety.

BACKGROUND OF THE INVENTION

1. Field of the Invention

The present invention relates to an anchor for a ship, and more particularly to an anchor for a ship that may facilitate retrieval of the anchor as a folding operation of the anchor is smoothly performed by improving a design of a contact portion such that a mechanical contact resistance of components that perform an folding operation of the anchor is minimized.

2. Description of the Prior Art

An anchor, for example, is a device that is submerged on the bottom of water when a ship moors on a seashore or a dock, and usually includes a long shank that is connected to a string or a wire and a hook-shaped anchor aim.

The anchor has to have a sufficient weight and a structure that allows the anchor to be fixed to the bottom of the water properly, for its purpose.

However, the anchors often cannot be easily retrieved due to an underground structure, and in this case, the string or wire connected to the anchor usually has to be cut in and a new anchor has to be purchased and mounted consequently.

In order to solve the problem, as disclosed in Korean Patent Application No. 10-2016-0110634 (Filing date: Aug. 30, 2016), the applicant developed an anchor for a ship that may allow the anchor to be easily retrieved without loss of the anchor even in a situation in which the anchor arm is caught by an underground structure and cannot be extracted when the ship leaves the harbor after mooring.

However, In the patent, the anchor am is mounted on a fixing piece at an end of a hollow fixing structure to be foldable so that a surface interference is generated and smooth folding is not possible in a process of contacting an inner portion of the anchor arm and an end of the shank when a folding operation is performed. Accordingly, a demand on design has been an interest to improve the problem.

PRIOR TECHNICAL DOCUMENTS

Patent Documents

Korean Patent No. 10-1185741 (Published on Sep. 19, 2012)

SUMMARY OF THE INVENTION

The present invention has been made in an effort to solve the above-mentioned problems, and provides an anchor for a ship that may allow a smooth folding operation of an anchor aim by improving a design at a contact portion such that a mechanical contact resistance between components that perform the folding operation of the anchor am so that, for example, the anchor may be easily retrieved without cutting the wire or the iron chain, that is, without loss of the anchor in a situation in which the anchor arm is caught by an underwater structure not to be pulled out when the ship leaves a harbor after mooring.

In accordance with an aspect of the present invention, there is provided an anchor for a ship including a shank having a structure in which one end of the shank is connected to a wire or an iron chain, and an anchor aim mounted to a lower end of the shank to be seated under the water to be fixed, wherein the shank includes a hollow cylindrical casing, a fixing cap is inserted into an opened upper portion of the cylindrical casing, the fixing cap is supported by a cap support member on a lower side thereof in the interior of the cylindrical casing, an elastic member is disposed on a lower side of the cap support member, a plurality of fixing pieces are disposed to form pairs on a radially outer surface of an end of the cylindrical casing, and third through-holes are formed at middle portions of the fixing piece, and wherein shank upper rod passes through a first through-hole that passes through the center of the fixing cap and extend downwards, a lower end of the shank upper rod is located in a second through-hole that passes through the center of the cap support member, the lower end of the shank upper rod is coupled to an upper end of a shank lower rod disposed below the shank upper rod, the elastic member is disposed on a radially outer side of the shank lower rod, a shank end is formed on a vertically lower side of the elastic member, the shank end has a structure that is inclined such that it becomes narrower toward a radially inner side as it goes downwards, and the shank end is disposed to be surrounded by the cylindrical casing, except for a portion that is inclined to become narrower to a radially inner side.

The anchor aim may be mounted between the fixing pieces to be foldable radially with respect to the cylindrical casing and the shank end.

The anchor aim may include an aim and a fluke, a crown in a curved form is formed at a fixed end of the aim, a fourth-through hole is formed at a middle portion of the crown, and in a state in which the crown is inserted between the fixing pieces, the anchor aim is mounted to be foldable in a radial direction with respect to the cylindrical casing and the shank end by a coupling bolt and inserted into the third through-holes of the fixing pieces and the fourth through-hole of the crown and a coupling nut.

The shank end may include a first linear portion extending vertically downwards by a predetermined length, a second linear portion extending from a lower end of the first linear portion to a radially inner side by a predetermined interval to form a step and then extending vertically downwards, a first inclined portion extending to be inclined to a radially inner side from an end of the second linear portion, and a second inclined portion extending to be inclined to a radially inner side from an end of the first inclined portion, and the crown includes an arc-shaped curved portion at a portion that contacts the shank end, a third inclined portion extending from one radial end of the arc-shaped curved portion to be inclined to a radially inner side by a predetermined angle, a fourth inclined portion extending to a radially outer side to be inclined with respect to the third inclined portion, and a fifth inclined portion extending to a radially inner side to be inclined with respect to the fourth inclined portion The inclination angle of the second inclined portion may be larger than the inclination angle of the first inclined portion, the inclination angle of the fourth inclined portion may be larger than the inclination angle of the third inclined portion, the inclined portion of the fifth inclined portion may be the same as the inclined angle of the fourth inclined portion, and the fourth inclined portion and the fifth inclined portion may be connected to each other to form a conic shape.

When the anchor aim is fully deployed horizontally, the first inclined portion of the shank end and the third inclined portion of the crown may be attached to each other while contacting each other, and the second inclined portion of the shank end and the fourth inclined portion of the crown are adhered to each other while contacting each other.

In a state in which the anchor aim is fully deployed with respect to the cylindrical casing and the shank end, an angle between the third inclined portion of the crown and the center line of the shank, that is, an imaginary line that connects the shank upper rod and the center of the shank lower rod may be 15 degrees, and an angle between the fourth inclined portion of the crown and the center line of theshank, that is, an imaginary line that connects the shank upper rod and the center of the shank lower rod may be 36 degrees If the shank is pulled upwards in a state in which the anchor aim is fully deployed with respect to the cylindrical casing and the shank end, the shank upper rod and the shank lower rod are moved vertically upwards, and then, the shank end fixed to a lower end of the shank lower rod also moves vertically upwards while overcoming an elastic force of the elastic member that is a compression spring, and accordingly, the shank end adhered to the crown of the anchor arm is extracted from the crown and the contact support of the crown of the anchor and the shank end is released so that the arm of the anchor arm is prolonged while becoming narrower to the radially inner side, and by using the operation, the anchor for a ship caught by a rock escapes from the rock.

If the shank is pulled upwards in a state in which the anchor aim is fully deployed with respect to the cylindrical casing and the shank end, the shank upper rod and the shank lower rod are moved vertically upwards, and then, the shank end fixed to a lower end of the shank lower rod also moves vertically upwards while overcoming an elastic force of the elastic member that is a compression spring, and if the shank end moves vertically upwards, the first inclined portion of the shank end that contacts the third inclined portion of the crown moves upwards over the third inclined portion of the crown first, and then the contact of the outer surface of the shank end and the crown is released, and accordingly, the anchor arm is rotated counterclockwise about the coupling bolt that functions as a pivot shaft, and if the shank is continuously pulled upwards, a pivot operation of the anchor arm is smoothly completed without being hampered while the first inclined portion of the shank end and the arc-shaped curved portion of the crown contact each other so that a full folding state is accomplished.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Figure 1:
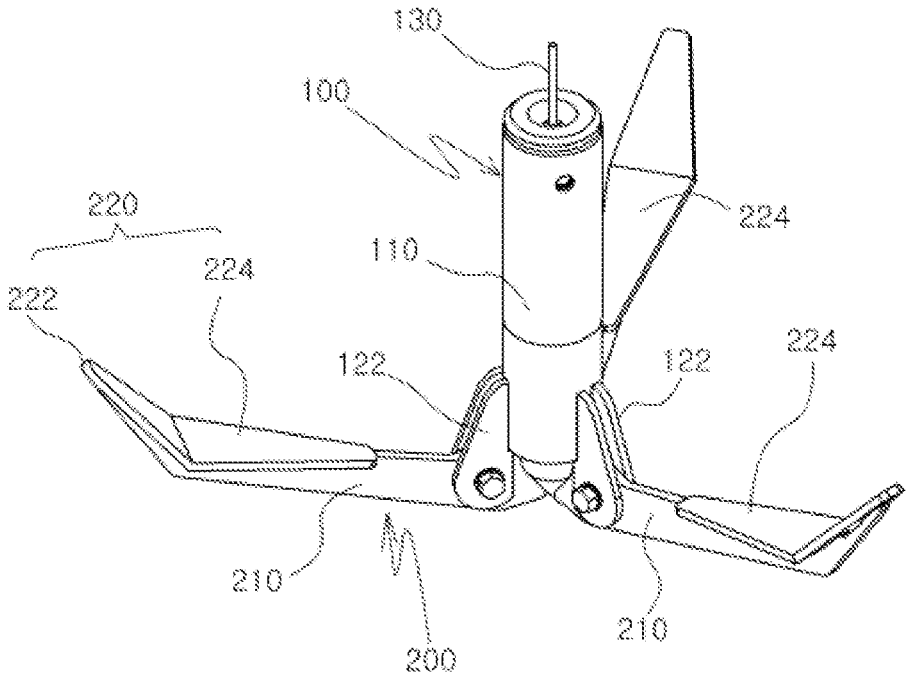
FIG. 1 is a perspective view schematically illustrating an entire appearance of an anchor for a ship according to a preferred embodiment of the present invention.

The drawings and a detailed description of the application simply relates to embodiments of the present invention. The advantages and other features of the mechanisms and methods described herein will become clearer to those skilled in the art to which the present invention pertains through a detailed description of the present invention, in which the accompanying drawings illustrating representative embodiments of the present invention are referenced. Otherwise emphasized, the similar or corresponding elements may be denoted by similar or corresponding reference numerals throughout the drawings.

Before a detailed description of at least one embodiment of the present invention, it will be understood that the present invention is not limited to the configurations and arrangements of components described in the specification or illustrated in the drawings in the application. According to the present invention, various embodiments are possible and may be performed and executed in various methods. Further, it may be understood that the grammars and terms employed herein are for description of the present invention and are not intended to limit the present invention.

Hereinafter, an anchor for a ship having a foldable structure according to a preferred embodiment of the present invention will be described with reference to the accompanying drawings.

Figure 2:
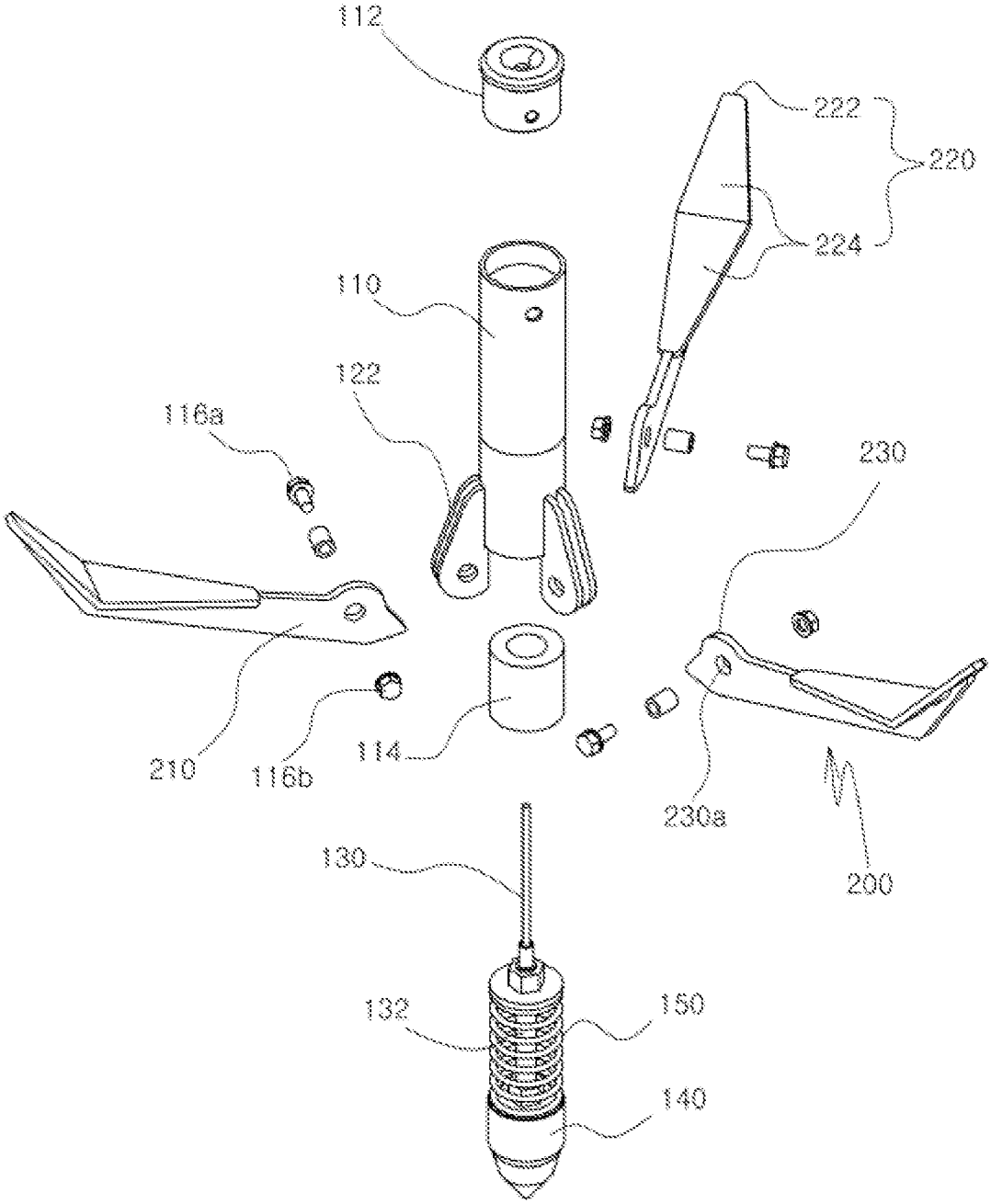
FIG. 2 is an exploded perspective view of the anchor for a ship illustrated in FIG. 1.
Figure 3:
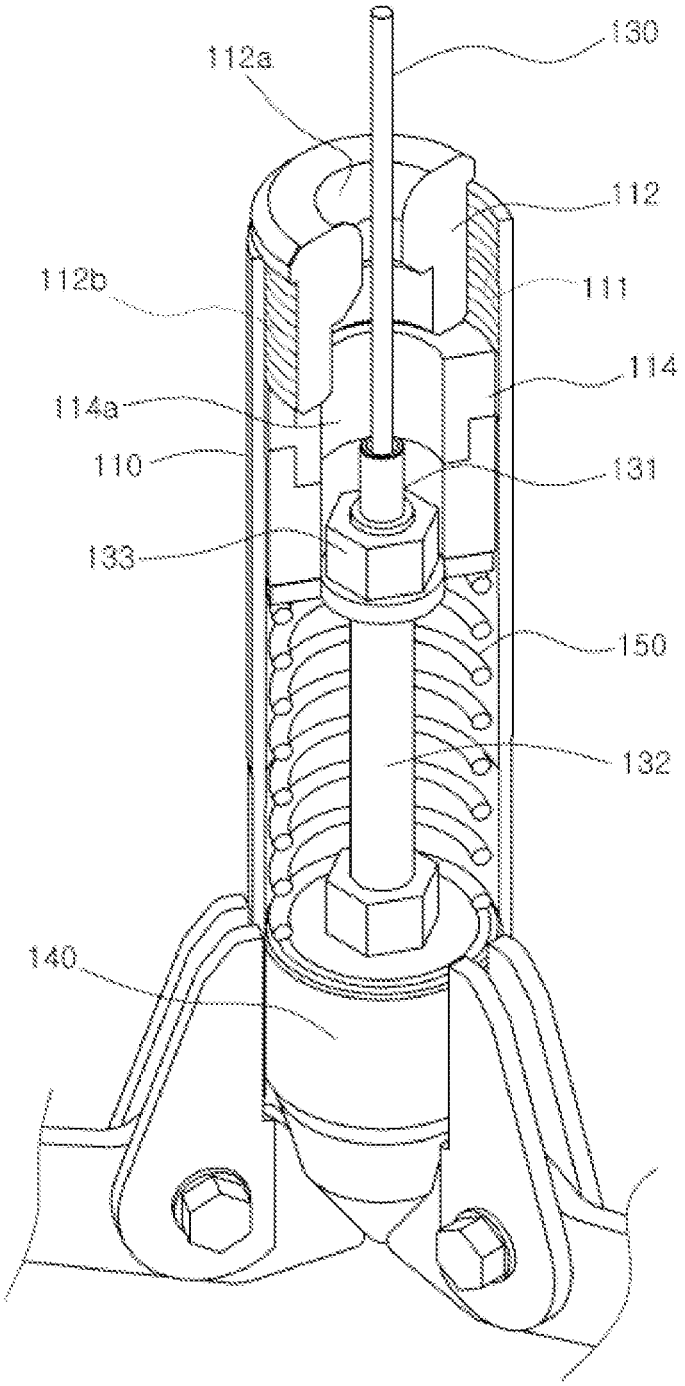
FIG. 3 is a partially cutaway view illustrating a main part of the anchor for a ship illustrated in FIG. 1.

FIGS. 1 and 2 illustrate a structure of an anchor for a ship according to the preferred embodiment of the present invention.

Referring to FIGS. 1 and 2, the anchor for a ship according to the preferred embodiment of the present invention basically includes a shank 100, one end of which has a structure connected to a wire or an iron chain, and anchor arms 200 mounted to a lower end of the shank and seated under the water to be fixed.

First, the shank 100 includes a hollow cylindrical casing 110. A fixing cap 112 is inserted into an opened upper portion of the cylindrical casing 110, the fixing cap 112 is supported by a cap support member 114 disposed on the lower side thereof in the interior of the cylindrical casing 110, and an elastic member (150) such as a compression spring is disposed on the lower side of the cap support member 114. In this way, a screw thread 112*b* is formed circumferentially on the outside of the fixing cap 112, and a screw thread 111 is also formed in the interior of the casing 110 corresponding to screw thread for the fixing cap 112 so that upward and downward manipulations of the fixing cap 112 are separately performed. A location of the cap support member 114 is adjusted together according to a fixing location of the fixing cap 112 due to the structure so that the elasticity of the elastic member 150 disposed in the interior of the casing 110 is arbitrarily adjusted.

Then, a shank upper rod 130 passes through a first through-hole 112*a* that passes through the center of the fixing cap 112 and extend downwards, and a lower end of the shank upper rod 130 is located in a second through-hole 114*a* that passes through the center of the cap support member 114. The lower end of the shank upper rod 130 is coupled to an upper end of a shank lower rod 132 disposed below the shank upper rod 130. A fastening piece 131 is disposed on the radially outer side of the lower end of the shank upper rod 130, and a fastening nut 133 such as a hexagon nut is disposed on the radially outer side of the fastening piece 131. The fastening piece 131 integrally extends upwards from the upper end of the shank lower rod 132 by a predetermined length, and the fastening piece 131 is fastened to the radially inner side by fastening the fastening nut 133 with a separate fastening tool (not illustrated) such as a hexagon wrench so that the lower end of the shank upper rod 130 is fastened and fixed.

The above-described elastic member 150 is disposed on the radially outer side of the shank lower rod 132 disposed below the lower end of the shank upper rod 130. A lower surface of the cap support member 114 is supported by an upper end of the elastic member 150 while contacting the upper end of the elastic member 150. A shank end 140 is formed on the vertically lower side of the elastic member 150, and preferably, the shank end 140 has a structure that is inclined such that it becomes narrower toward the radially inner side as it goes downwards. The shank end 140 is disposed to be surrounded by the cylindrical casing 110, except for the portion that is inclined to become narrower to the radially inner side.

Meanwhile, the anchor aim 200 is mounted to be foldable radially with respect to the cylindrical casing 110 and the shank end 140. Preferably, three anchor aims 200 are mounted to be foldable radially with respect to the cylindrical casing 110 and the shank end 140 at an interval of 120 degrees. To achieve this, a plurality of fixing pieces 122 is formed on the radially outer surface of the end of the cylindrical casing 110 at an interval of 120 degrees to protrude. The fixing pieces 122 are disposed to form pairs, and third through-holes 122*a* are formed at the middle portions of the fixing pieces 122, respectively. The anchor arms 200 are mounted between the fixing pieces 122 that form pairs.

The anchor aim 200 mainly includes an arm 210 and a fluke 220, and then, the fluke 220 in turn includes a bill 222 and a palm 224. The fluke 220 is integrally formed over a partial area of an upper surface of the aim 210, the bill 222 is formed at a free end of the arm 210, and two adjacent folding parts that form an angle such that the palms 224 having palm shapes are inclined with respect to each other at a radially inner location of the bill 222.

A crown 230 in a curved form is formed at a fixed end of the aim 210. A fourth-through hole 230*a* is formed at a middle portion of the crown 230. In a state in which the crown 230 of the aim 210 of the anchor aim 200 is inserted between the fixing pieces 122 disposed to form a pair, the anchor aim 200 is mounted to be foldable in a radial direction with respect to the cylindrical casing 110 and the shank end 140 by a coupling bolt 116*a* inserted into the third through-holes 122*a* of the fixing pieces 122 and the fourth through-hole 230*a* of the crown 230 and a coupling nut 116*b*. Then, the coupling bolt 116*a* functions as a pivot shaft that supports the anchor aim 200 such that the anchor aim 200 may pivot to the radially inner and outer sides.

Figure 4:
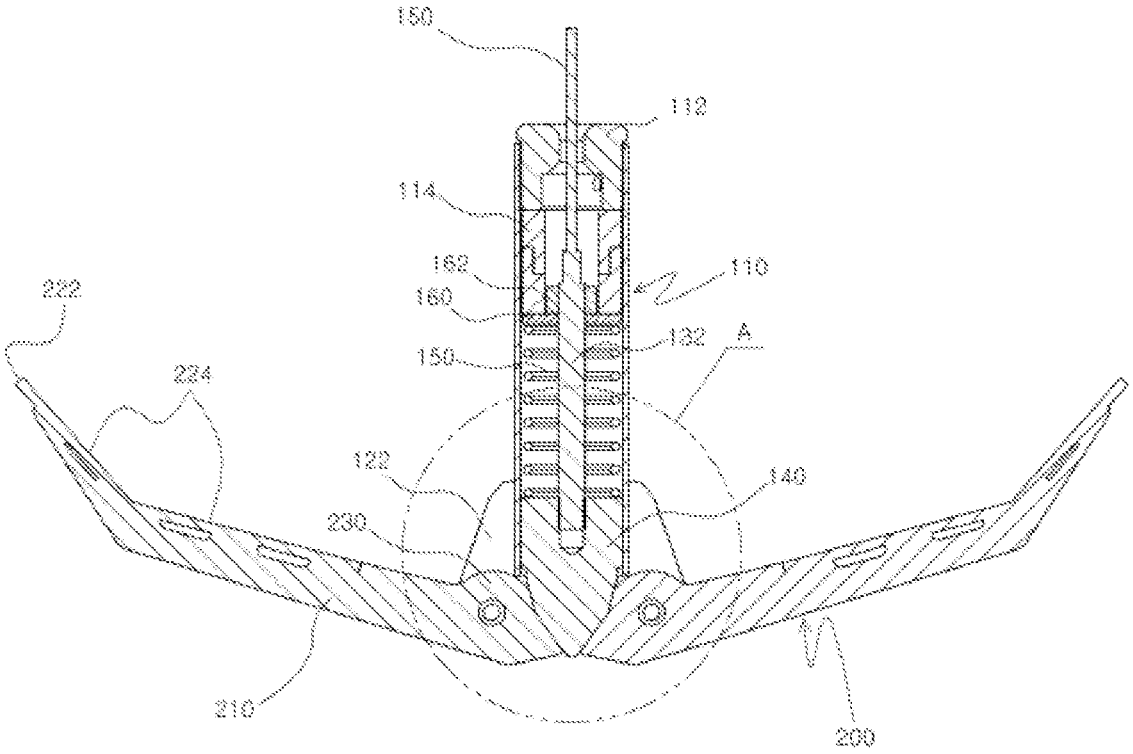
FIG. 4 is a longitudinal sectional view of the anchor for a ship illustrated in FIG. 1, and is a longitudinal sectional view for two anchor arms for convenience of description.
Figure 5:
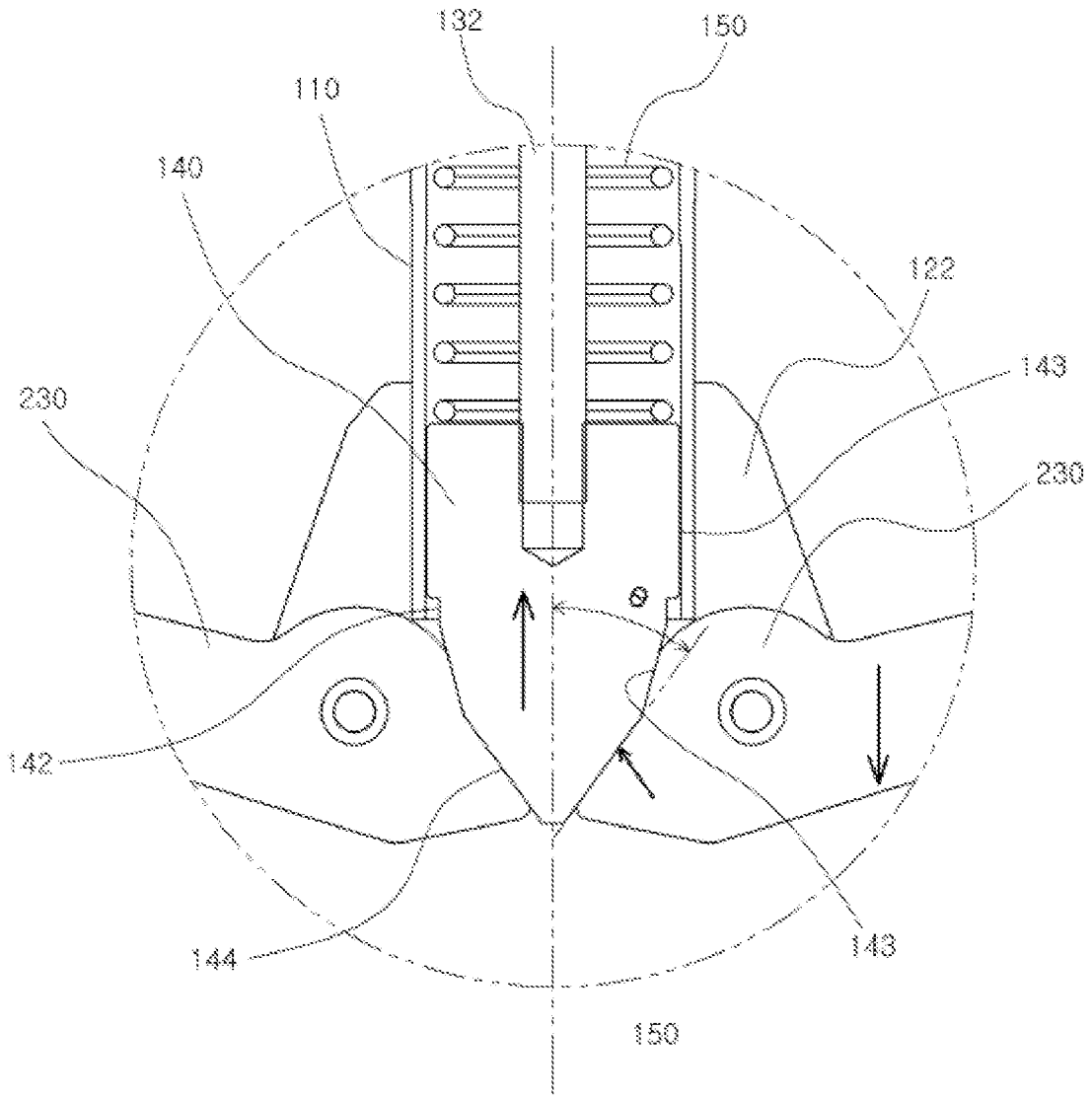
FIG. 5 is an enlarged view of portion A of the anchor for a ship illustrated in FIG. 4, and is a view in which illustration of a section is omitted for convenience of description.

FIGS. 4 and 5 illustrate a contact state of the crown 230 and the shank end 140 at a fixed end of the aim 210 in detail.

Referring to FIGS. 4 and 5, as mentioned above, the shank end 140 formed at the vertically lower side of the elastic member 150 has an inclined structure to become narrower to the radially inner side as it goes downwards.

The shank end 140 includes a first linear portion 141 extending vertically downwards by a predetermined length, a second linear portion 142 extending from a lower end of the first linear portion 141 to the radially inner side by a predetermined interval to form a step and then extending vertically downwards, a first inclined portion 143 extending to be inclined to the radially inner side from an end of the second linear portion 142, and a second inclined portion 144 extending to be inclined to the radially inner side from an end of the first inclined portion 143. Then, the inclination angle of the second inclined portion 144 is larger than the inclined portion of the first inclined portion 143. The second linear portion 142, the first inclined portion 143, and the second inclined portion 144 are connected to each other smoothly.

In correspondence to the outer shape of the above-configured shank end 140, the crown 230 is adhered to the shank end 140 when the anchor aim 200 is deployed and is formed such that an folding operation thereof is not hindered when the anchor aim 200 is folded.

To achieve this, the crown 230 includes an arc-shaped curved portion 231 at a portion that contacts the shank end 140, a third inclined portion 233 extending from one radial end of the arc-shaped curved portion 231 to be inclined to the radially inner side by a predetermined angle, a fourth inclined portion 234 extending to the radially outer side to be inclined with respect to the third inclined portion 233, and a fifth inclined portion 235 extending to the radially inner side to be inclined with respect to the fourth inclined portion 234. Then, the inclination angle of the fourth inclined portion 234 is larger than the inclination angle of the third inclined portion 233, and the inclined portion of the fifth inclined portion 235 is substantially the same as the inclined angle of the fourth inclined portion 234. The fourth inclined portion 234 and the fifth inclined portion 235 are connected to each other to form a conic shape. The arc-shaped curved portion 231, the third inclined portion 233, the fourth inclined portion 234, and the fifth inclined portion 235 are connected to each other smoothly.

As illustrated in FIG. 5, when the anchor arm 200 is fully deployed horizontally, the first inclined portion 143 of the shank end 140 and the third inclined portion 233 of the crown 230 are attached to each other while contacting each other, and the second inclined portion 144 of the shank end 140 and the fourth inclined portion 234 of the crown 230 are adhered to each other while contacting each other. Through the adherence and contact of the shank end 140 and the crown 230, the anchor aim 200 is supported while being fully deployed.

In a state in which the anchor aim 200 is fully deployed with respect to the cylindrical casing 110 and the shank end 140, an angle (θ1) between the third inclined portion 233 of the crown 230 and the center line of the shank 100, that is, an imaginary line that connects the shank upper rod 130 and the center of the shank lower rod 132 is 15 degrees. Further, an angle (θ2) between the fourth inclined portion 234 of the crown 230 and the center line of the shank 100, that is, an imaginary line that connects the shank upper rod 130 and the center of the shank lower rod 132 is 36 degrees.

Figure 6:
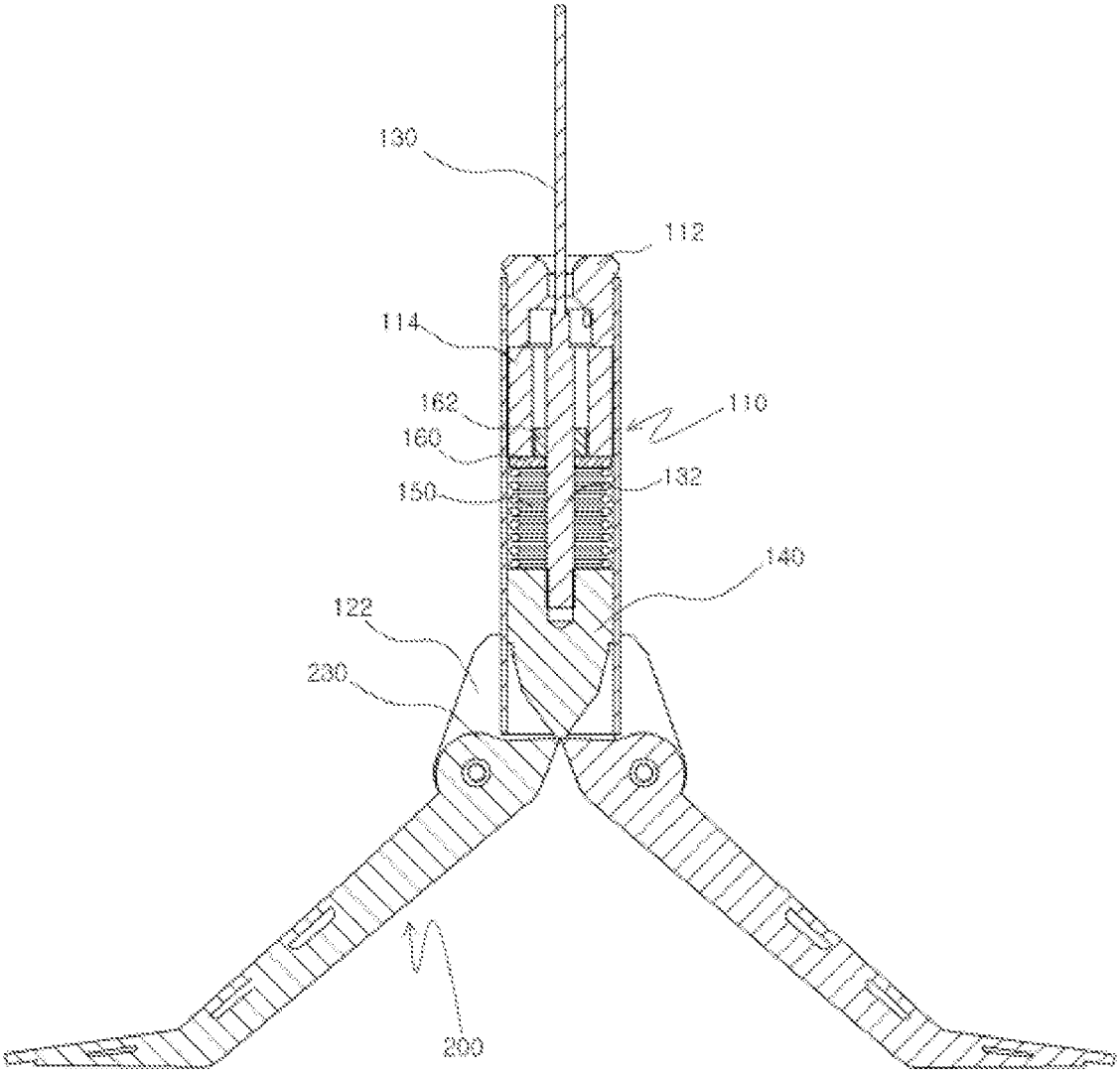
FIG. 6 is a sectional view illustrating an appearance in which the anchor arms of the anchor for a ship are deployed to the rear side according to the embodiment of the present invention.

FIG. 6 illustrates a state in which the anchor aim 200 of the anchor for a ship according to the preferred embodiment of the present invention is deployed rearwards.

Referring to FIG. 6, the anchor for a ship having a foldable structure according to the preferred embodiment of the present invention may be caught by an obstacle such as a rock when it is submerged under the water, and may be damaged due to a high load applied to the shank 100 or the anchor aim 200 if an excessive folding operation is performed in this state.

In order to solve the problem, according to the present invention, the shank 100 may be pulled upwards in the deployment state as in FIG. 4. Then, the shank upper rod 130 and the shank lower rod 132 are moved vertically upwards, and then, the shank end 140 fixed to a lower end of the shank lower rod 132 also moves vertically upwards while overcoming an elastic force of the elastic member 150 that is a compression spring. Accordingly, the shank end 140 adhered to the crown 130 of the anchor aim 200 is extracted from the crown 230 and the contact support of the crown 230 of the anchor 200 and the shank end 140 is released so that the aim 210 of the anchor aim 200 is prolonged while becoming narrower to the radially inner side. By using the operation, the anchor for a ship caught by a rock may escape from the rock.

Figure 7:
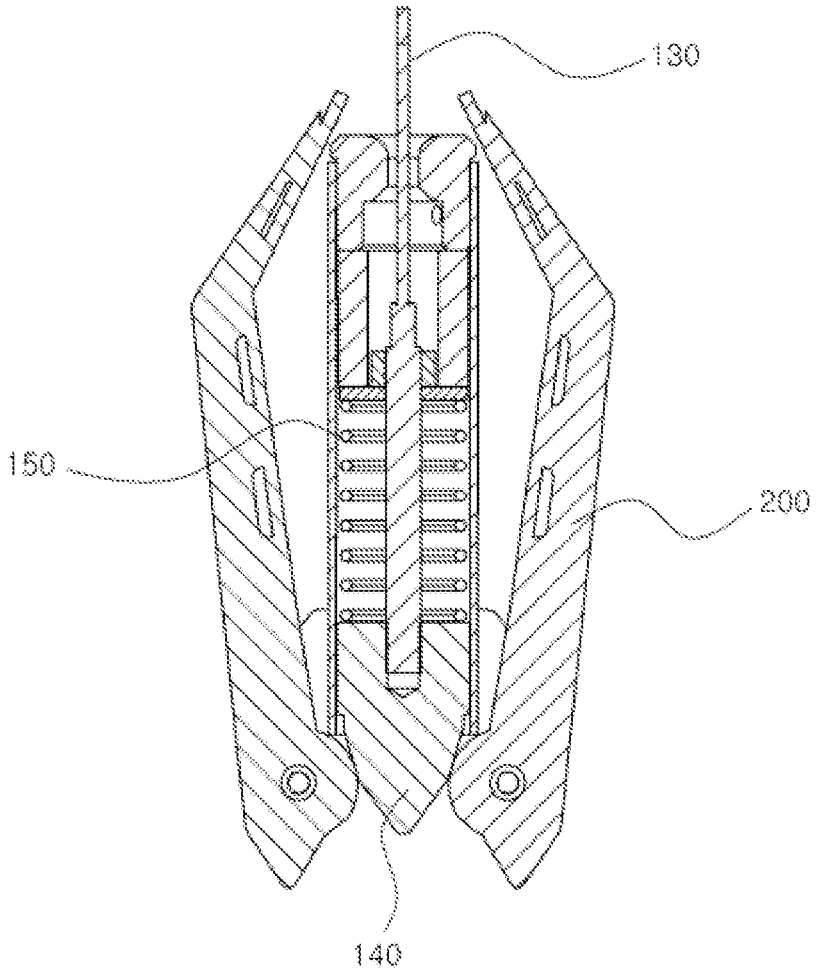
FIG. 7 is a sectional view illustrating a state in which the anchor arms of the anchor for a ship according to the preferred embodiment of the present invention is folded toward the inside for keeping or carrying.
Figure 8A:
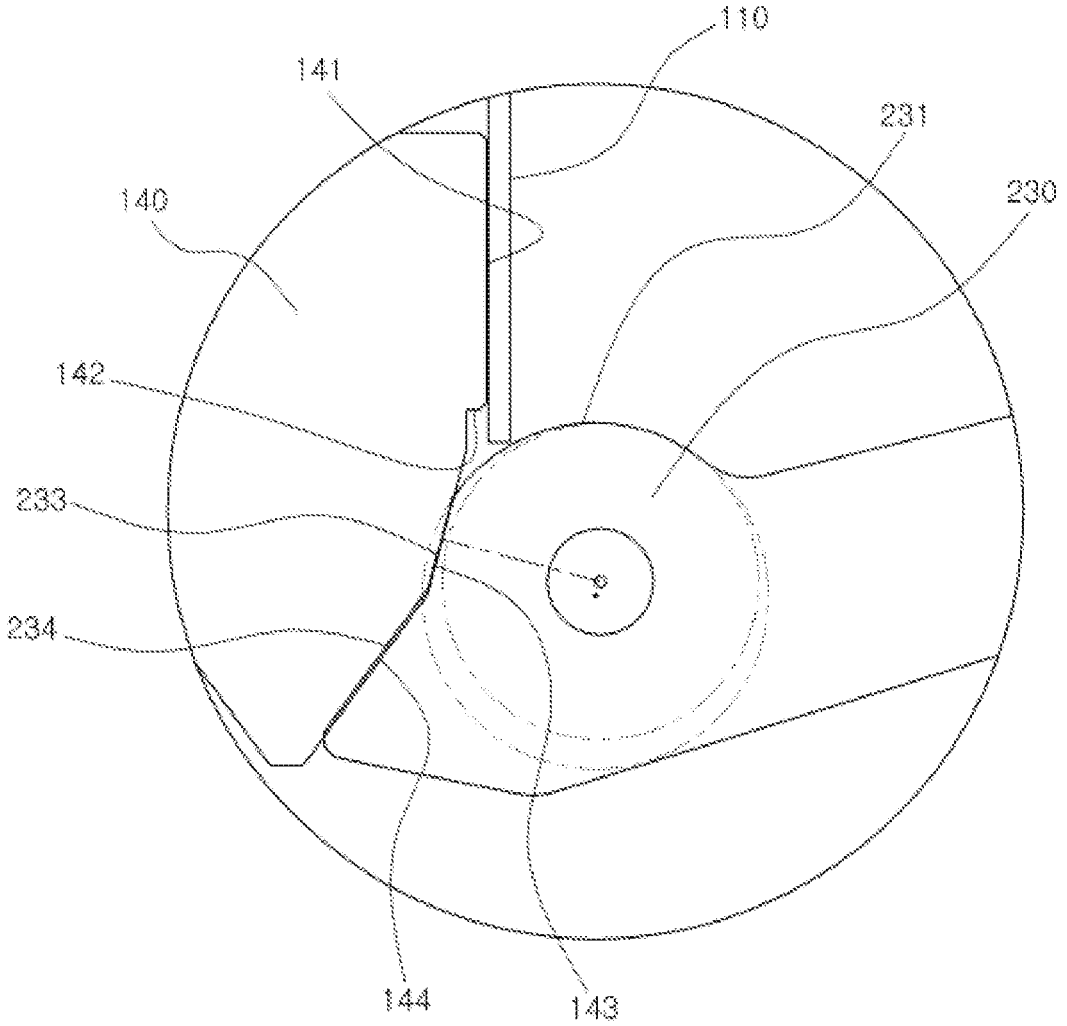
FIGS. 8A to 8D are views illustrating appearances of a pivot shaft part of the anchor aim when the anchor arm is folded toward the inside as illustrated in FIG. 7.
Figure 8B:
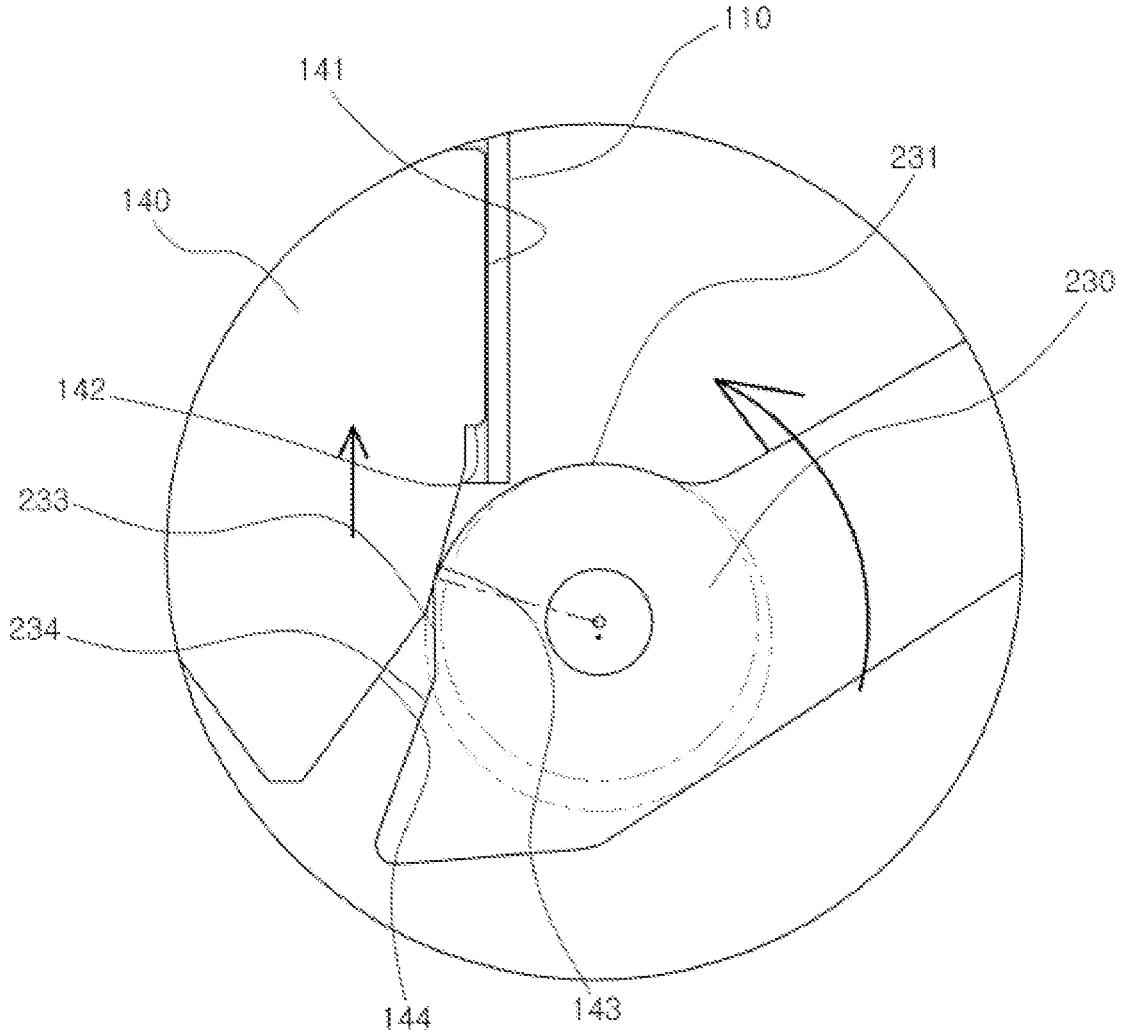
Figure 8C:
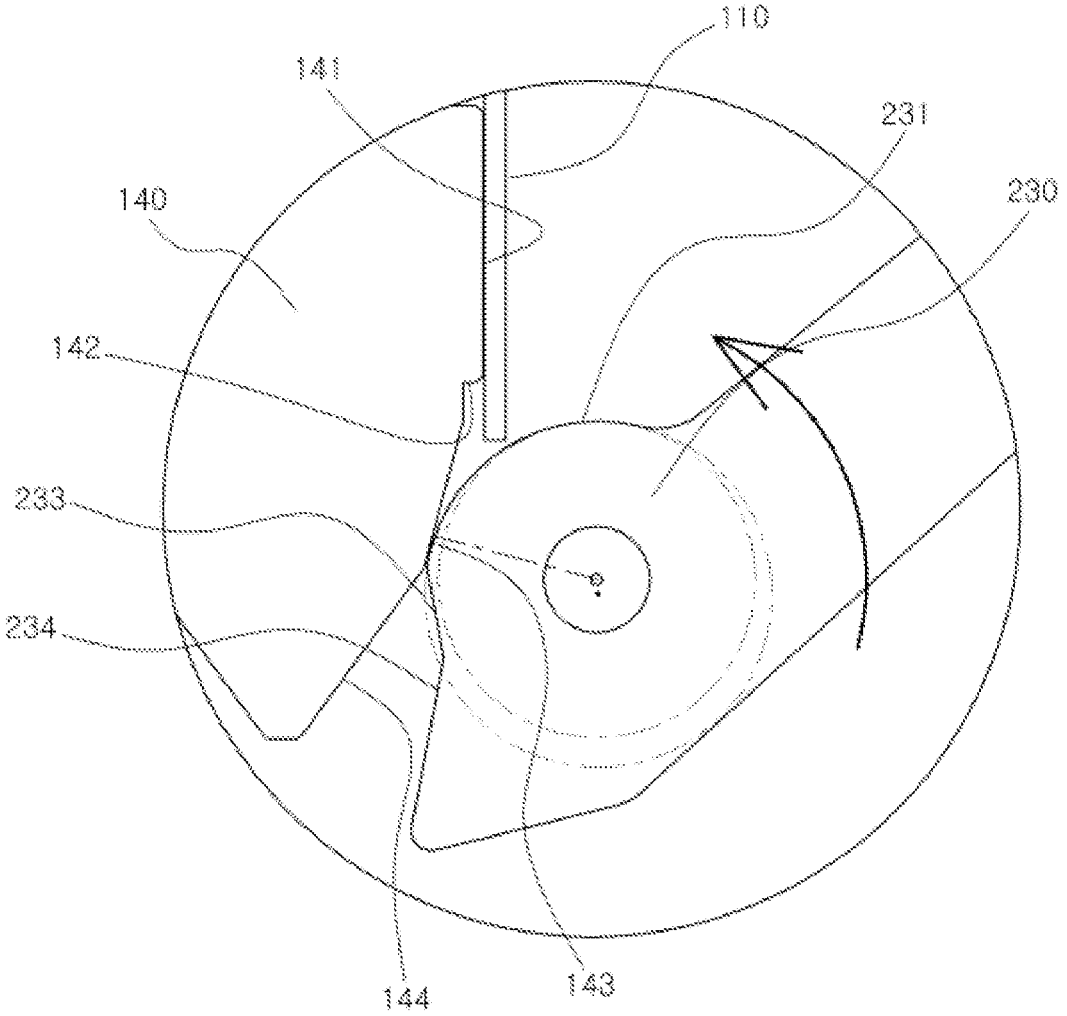
Figure 8D:
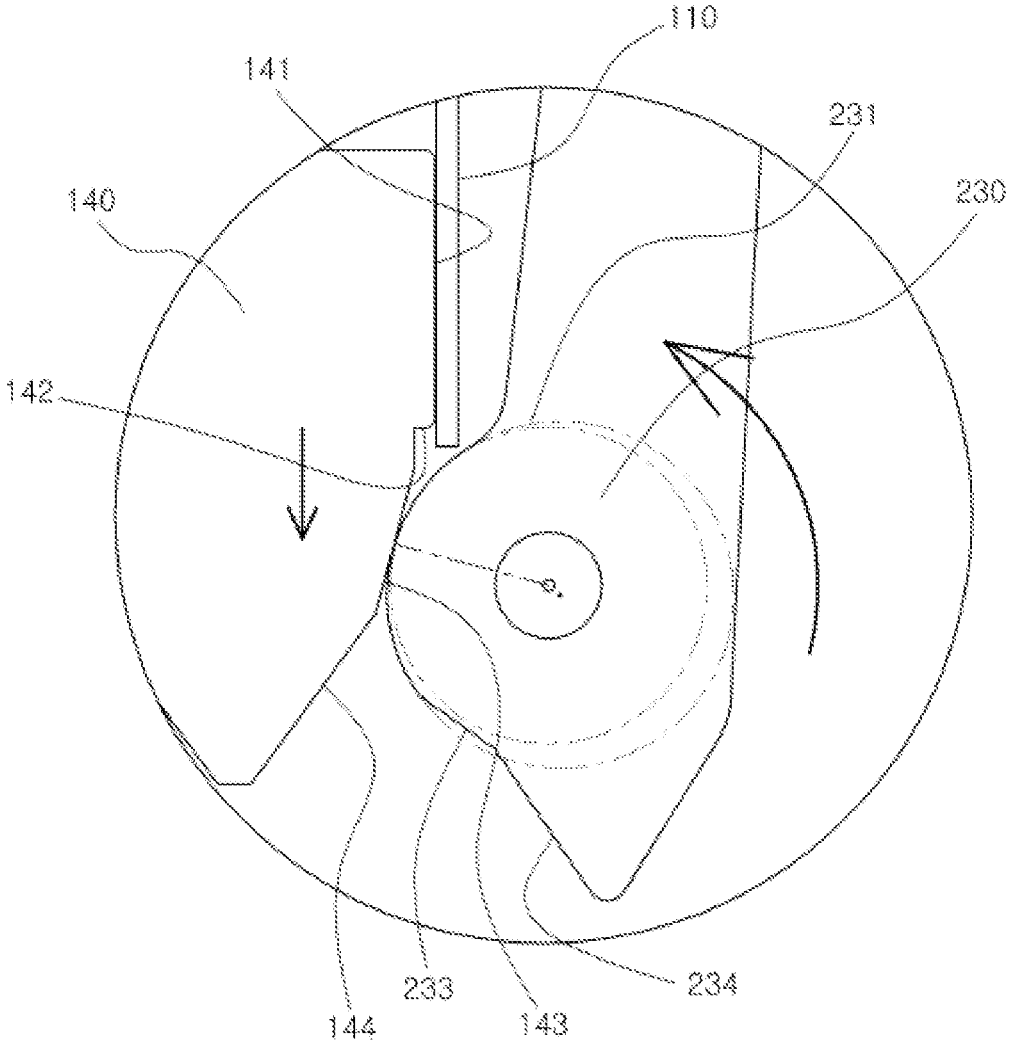

FIG. 7 is illustrates a state in which the anchor aims of the anchor for a ship according to the preferred embodiment of the present invention is folded toward the inside for keeping or carrying. FIGS. 8A to 8D illustrate appearances of a pivot shaft part of the anchor aim when the anchor aim is folded toward the inside as illustrated in FIG. 7.

A folding operation from a deployment state of FIG. 4 to a folding state of FIG. 7 is performed to keep the anchor for a ship according to the preferred embodiment of the present invention, and the operation is sequentially illustrated in FIGS. 8A to 8D.

Referring to FIGS. 8A to 8D, the shank 100 is pulled upwards in the deployment state illustrated in FIG. 4. Then, the shank upper rod 130 and the shank lower rod 132 are moved vertically upwards, and then, the shank end 140 fixed to a lower end of the shank lower rod 132 also moves vertically upwards while overcoming an elastic force of the elastic member 150 that is a compression spring.

If the shank end 140 moves vertically upwards, the first inclined portion 143 of the shank end 140 that contacts the third inclined portion 233 of the crown 230 moves upwards over the third inclined portion 233 of the crown 230 first, and then the contact of the outer surface of the shank end 140 and the crown 230 is released. Accordingly, the anchor aim 200 is rotated counterclockwise about the coupling bolt 116*a* that functions as a pivot shaft.

If the shank 100 is continuously pulled upwards, the pivot operation of the anchor aim 200 is smoothly completed without being hampered while the first inclined portion 143 of the shank end 140 and the arc-shaped curved portion 231 of the crown 230 contact each other. As a result, the full folding state illustrated in FIG. 7 is accomplished.

According to the present invention, a mechanical contact resistance between the components may be minimized by improving the designs of the contact portions of the components that perform the folding operation of the anchor arm, and consequently, the anchor may be easily retrieved without cutting the wire or the iron chain, that is, without loss of the anchor in a situation in which the anchor aim is caught by an underwater structure not to be pulled out when the ship leaves a harbor after the mooring. Accordingly, loss of the anchor caused by cutting the wire or the iron chain due to the obstacle that catches the anchor aim may be solved.

Although the embodiments of the present invention have been described, it will be understood by an ordinary person in the art that the present invention may be variously corrected and modified without departing from the spirit of the present invention described in the claims.

What is claimed is:

1. An anchor for a ship, the anchor comprising:

a shank having a structure in which one end of the shank is configured to be connected to a wire or an iron chain; and an anchor arm mounted to a lower end of the shank to be seated under water to be fixed, wherein the shank includes a hollow cylindrical casing, a fixing cap inserted into an opened upper portion of the cylindrical casing, the fixing cap being supported by a cap support member on a lower side thereof in an interior of the cylindrical casing, an elastic member disposed on a lower side of the cap support member, a plurality of fixing pieces disposed to form pairs on a radial outer surface of an end of the cylindrical casing, and a first through-hole formed at a middle portion of one of the plurality of fixing pieces, wherein a shank upper rod passes through a second through-hole that passes through a center of the fixing cap and extends downwards, a lower end of the shank upper rod is located in a third through-hole that passes through a center of the cap support member, the lower end of the shank upper rod is coupled to an upper end of a shank lower rod disposed below the shank upper rod, the elastic member is disposed on a radial outer side of the shank lower rod, a shank end is formed on a vertical lower side of the elastic member, the shank end has a structure that is inclined such that it becomes narrower toward a radial inner side as it goes downwards, and the shank end is disposed to be surrounded by the cylindrical casing, except for a portion that is inclined to become narrower to the radial inner side, wherein the anchor arm is mounted between the fixing pieces to be foldable radially with respect to the cylindrical casing and the shank end, wherein the anchor arm includes an arm and a fluke, a crown in a curved form is formed at a fixed end of the anchor arm, a fourth through-hole is formed at a middle portion of the crown, and in a state in which the crown is inserted between the fixing pieces, the anchor arm is mounted to be foldable in a radial direction with respect to the cylindrical casing and the shank end by a coupling bolt and inserted into the third through-hole of one of the fixing pieces and the fourth through-hole of the crown and a coupling nut, and wherein the shank end includes a first linear portion extending vertically downwards by a predetermined length, a second linear portion extending from a lower end of the first linear portion to the radial inner side by a predetermined interval to form a step and then extending vertically downwards, a first inclined portion extending to be inclined to the radial inner side from an end of the second linear portion, and a second inclined portion extending to be inclined to the radial inner side from an end of the first inclined portion, and the crown includes an arc-shaped curved portion at a portion that contacts the shank end, a third inclined portion extending from one radial end of the arc-shaped curved portion to be inclined to the radial inner side by a predetermined angle, a fourth inclined portion extending to a radial outer side to be inclined with respect to the third inclined portion, and a fifth inclined portion extending to the radial inner side to be inclined with respect to the fourth inclined portion.

2. The anchor of claim 1, wherein an inclination angle of the second inclined portion is larger than an inclination angle of the first inclined portion, an inclination angle of the fourth inclined portion is larger than an inclination angle of the third inclined portion, the inclined portion of the fifth inclined portion is the same as the inclination angle of the fourth inclined portion, and the fourth inclined portion and the fifth inclined portion are connected to each other to form a conic shape.

3. The anchor of claim 2, wherein when the anchor arm is fully deployed horizontally, the first inclined portion of the shank end and the third inclined portion of the crown are attached to each other while contacting each other, and the second inclined portion of the shank end and the fourth inclined portion of the crown are adhered to each other while contacting each other.

4. The anchor of claim 3, wherein in a state in which the anchor arm is fully deployed with respect to the cylindrical casing and the shank end, an angle between the third inclined portion of the crown and the center line of the shank, that is, an imaginary line that connects the shank upper rod and the center of the shank lower rod is 15 degrees, and an angle between the fourth inclined portion of the crown and the center line of the shank, that is, an imaginary line that connects the shank upper rod and the center of the shark lower rod is 36 degrees.

5. The anchor of claim 4, wherein if the shank is pulled upwards in a state in which the anchor arm is fully deployed with respect to the cylindrical casing and the shank end, the shank upper rod and the shank lower rod are moved vertically upwards, and then, the shank end fixed to a lower end of the shank lower rod also moves vertically upwards while overcoming an elastic force of the elastic member that is a compression spring, and accordingly, the shank end adhered to the crown of the anchor arm is extracted from the crown and the contact support of the crown of the anchor and the shank end is released so that the arm of the anchor arm is prolonged while becoming narrower to the radial inner side, and by using the operation, the anchor for a ship caught by a rock escapes from the rock.

6. The anchor of claim 4, wherein if the shank is pulled upwards in a state in which the anchor arm is fully deployed with respect to the cylindrical casing and the shank end, the shank upper rod and the shank lower rod are moved vertically upwards, and then, the shank end fixed to a lower end of the shank lower rod also moves vertically upwards while overcoming an elastic force of the elastic member that is a compression spring, and if the shank end moves vertically upwards, the first inclined portion of the shank end that contacts the third inclined portion of the crown moves upwards over the third inclined portion of the crown first, and then the contact of the outer surface of the shank end and the crown is released, and accordingly, the anchor arm is rotated counterclockwise about the coupling bolt that functions as a pivot shaft, and if the shank is continuously pulled upwards, a pivot operation of the anchor arm is smoothly completed without being hampered while the first inclined portion of the shank end and the arc-shaped curved portion of the crown contact each other so that a full folding state is accomplished.

7. The anchor of claim 1, wherein a screw thread is formed on an outer peripheral surface of the fixing cap and a screw thread is also formed in the interior of the cylindrical casing corresponding to the thread of the fixing cap so that a location of the fixing cap with respect to the casing is arbitrarily determined whereby an elasticity due to a necessity of the elastic member is adjusted.

* * * * *